United States Patent [19]

deNevers et al.

[11] Patent Number: 4,809,522

[45] Date of Patent: Mar. 7, 1989

[54] SERVER FOR DISPLAYING AND KEEPING COOL WINE BOTTLES AND THE LIKE

[75] Inventors: Noel H. deNevers; James H. Gardner; Robert M. Norton, all of Salt Lake City, Utah

[73] Assignee: Aurora Design Associates, Inc., Salt Lake City, Utah

[21] Appl. No.: 223,421

[22] Filed: Jul. 25, 1988

[51] Int. Cl.[4] ..... F25D 3/08

[52] U.S. Cl. ..... 62/457; 62/372; 62/430; 62/463; 62/530

[58] Field of Search ..... 62/430, 457, 372, 530, 62/463

[56] References Cited

U.S. PATENT DOCUMENTS

| | | | |
|---|---|---|---|
| 651,819 | 6/1900 | Bradshaw | 62/372 X |
| 3,434,302 | 3/1969 | Stoner et al. | 62/457 |
| 4,255,944 | 3/1981 | Gardner et al. | 62/457 |

FOREIGN PATENT DOCUMENTS

| | | | |
|---|---|---|---|
| 1127267 | 12/1956 | France | 62/457 |
| 494112 | 10/1938 | United Kingdom | 62/463 |

*Primary Examiner*—Lloyd L. King

*Attorney, Agent, or Firm*—Thorpe, North & Western

[57] ABSTRACT

A server for displaying and keeping cool wine bottles and the like includes a generally cylindrical housing open at the top for receiving a bottle, wherein the side wall of the housing generally conforms to and surrounds the side exterior of the bottle. A bottom wall is joined at its perimeter to the side wall to form a receptacle for housing ice in contact with the side wall. A support structure is positioned within the housing above the bottom wall to hold a bottle above and out of contact with the ice, with the support structure including an opening to allow placement of ice into the receptacle through the top opening of the housing. At least one-half of the area of the side wall is made of a heat conductive material and the remaining area of the side wall is made of a substantially transparent material to enable viewing the interior of the server. At least a portion of the heat conductive material of the side wall is positioned to contact ice placed in the receptacle and to extend vertically upwardly to surround a portion of a bottle placed in the server.

12 Claims, 1 Drawing Sheet

SERVER FOR DISPLAYING AND KEEPING COOL WINE BOTTLES AND THE LIKE

BACKGROUND OF THE INVENTION

This invention relates to a server for efficiently and conveniently maintaining the temperature of chilled wine or other beverage or food in a container while at the same time displaying the beverage or food.

In U.S. Pat. Nos. 4,255,944, 4,393,665 and 4,388,813, server constructions are described for effectively and efficiently maintaining the temperature of beverages at a stable level over a fairly long period of time. This is accomplished by providing a housing open at the top for receiving a bottle to be cooled, with the housing having a side wall which substantially surrounds the side exterior of the bottle. The side wall is made of a heat conductive material and is maintained in contact with ice either located within the side wall in an interior compartment or outside the side wall in an exterior compartment. The ice, even though in contact with only a portion of the side wall, serves to cool the entire side wall and this results in a cool barrier surrounding the bottle to prevent radiative heat transfer to the bottle.

The above-described construction has proven very popular with the consuming public both because of its efficiency and its compactness. However, the heat conductive material used to construct the side wall is typically extruded aluminum or other metallic alloy which, of course, is opaque and therefore prevents visual inspection of a bottle contained in the server. The use of such heat conductive material is also fairly expensive. It was believed that heat conductive material was necessary to completely surround the bottle in order to maintain the desired temperature, and thus the cost and lack of ability to view the bottles in the servers were deemed justified.

SUMMARY OF THE INVENTION

It is an object of the invention to provide a new, improved and less costly server for chilled wine bottles and similar beverage or food containers.

It is also an object of the invention to provide such a server in which the bottle and bottle label placed in the server can be viewed by a user.

It is a further object of the invention to provide such a server which, while accomplishing the above objectives, nevertheless still provides for effectively maintaining the temperature of the wine bottle at a stable level over a desired long period of time.

The above and other objects are realized in a specific illustrative embodiment of a server which includes a housing open at the top for receiving a bottle, with the housing, having a side wall shaped to generally conform to and surround the side exterior of the bottle, and a bottom wall joined at its perimeter to the side wall. The side wall and bottom wall form a receptacle for holding ice in contact with the side wall. A support platform is disposed within the housing above the bottom wall to hold the bottle above and out of contact with the ice. About one-half or more of the area of the side wall is made of a heat conductive material, with the remaining area of the side wall being made of a substantially transparent material to enable seeing therethrough to the interior of the server. At least a portion of the heat conductive material of the side wall is positioned to contact ice placed in the receptacle and to intercept and absorb heat from a portion of the side of the bottle.

In accordance with one aspect of the invention, the conductive material of the side wall is formed to extend vertically from the bottom to the top of the server and around about one-half or more of the circumference of the server. The transparent material extends around the other half of the circumference of the server to provide the desired viewing.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
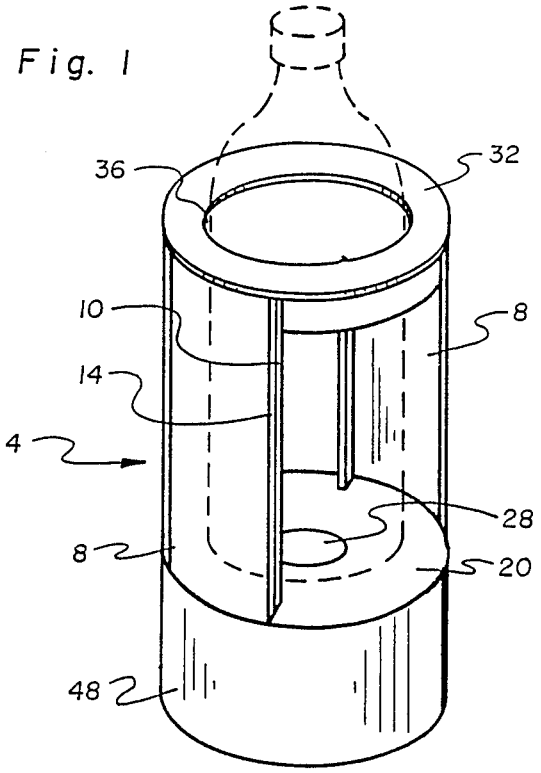
FIG. 1 shows a perspective view of a server made in accordance with the principles of the present invention.

Referring to the drawings, there is shown a server for displaying and keeping cool wine bottles or similar food or beverage holding containers. The server includes a housing 4 which includes a transparent cylindrical shell 8 which is open at the top to allow placement therein of a bottle of wine or similar container. The housing 4 also includes a bottom wall 12 which is joined to the bottom of the cylindrical shell 8 to form a water-tight container.

Figure 2:
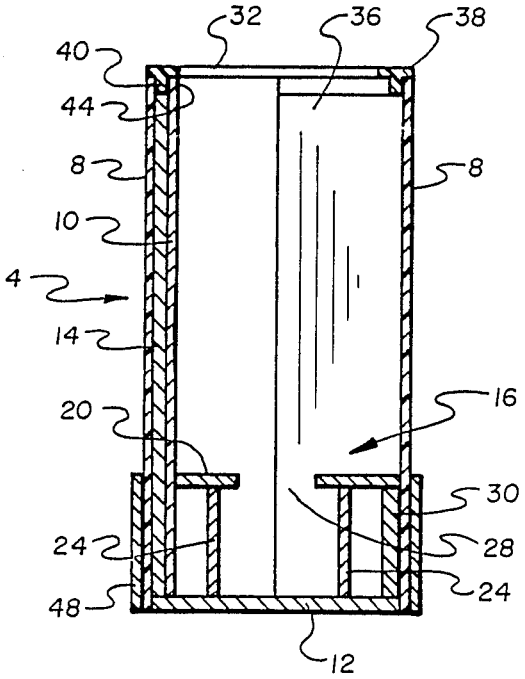
FIG. 2 is a side, elevational, cross-sectional view of the server of FIG. 1.

Fitted within the transparent shell 8 is a heat-conductive hemi-cylindrical shell 10 which extends from the bottom wall 12 to or near the top of the housing 4, and about one-half the distance circumferentially around the side of the housing. The shell 10 rests on the bottom wall 12, as shown in FIG. 2. Disposed between the transparent shell 8 and heat-conductive shell 10 is a hemi-cylindrical layer of insulation 14. The layer 14 extends from the bottom wall 12 to near the top of the housing 4, and circumferentially about the heat-conductive shell 4 to terminate coincidentally therewith at its side edges.

A support structure 16 is disposed at the bottom of the housing 4 to provide a support for a bottle placed therein. This support structure could take a variety of forms including that of an annular disk 20 whose perimeter is joined or in close proximity to the interior surface of the cylindrical shell 8 and hemi-cylindrical shell 10, and glued thereto, as best seen in FIG. 2. The disk 20 could be further supported (or alternatively solely supported) by rod-like legs 24 extending from the bottom wall 12 upwardly to the bottom surface of the disk 20. The disk 20 includes an opening 28 through which crushed ice may be placed to be held at the bottom of the housing 4. The opening may be centrally located, as shown in FIG. 2, or may be located adjacent an interior side wall which would facilitate draining water from the bottom of the housing. (The housing would simply be tipped in the direction of the location of the opening to allow draining water through the opening and out the top of the housing.) Below the disk 20 is positioned a piece of insulating material 30 which is laid adjacent the interior surface of the shell 8 not covered by insulation layer 14.

Disposed at the top of the housing 4 is an annular cap 32 having an opening 36 through which a bottle may be inserted into the interior of the cylindrical shell 8. The cap 32 includes a generally horizontally disposed lip 38 which fits over the top of the cylindrical shell 8, and a vertically disposed lip or ring 40 which fits within the cylindrical shell 8, as best seen in FIG. 2, and may be glued thereto. A recessed portion 44 of the cap 32 receives the shell 10 which may be glued thereto.

The cylindrical shell 8 is comprised of a transparent material such as polycarbonate resin. The shell 10 is comprised of a heat-conductive material such as aluminum, copper, silver, etc. The insulative layers 10 and 30 may be composed of closed cell foamed polyethylene or the like. A decorative cylindrical cover 48 surrounds the bottom of the transparent shell 8 to screen the support structure 16 from viewing. The cover might illustratively be made of an adhesivebacked laminate of metal foil and polyvinyl chloride for wrapping about the shell 8.

With the construction described, a wine bottle or similar article may be placed in the server to rest on the support structure 16 to allow viewing the label or other part of the bottle through the transparent shell 8.

A function of the heat conductive shell 10 is to provide a conductive path for heat radiated outwardly by a bottle placed in the server, to be conducted downwardly to the ice in the bottom part of the housing 4. Similarly, ambient heat will be intercepted by the heat conductive shell 10 and likewise conducted downwardly to the ice. To accomplish these functions, at least a portion of the heat conductive shell 10 must be in thermal contact with ice placed in the bottom of the housing 4 and must extend upwardly to surround about one-half of the outside of the bottle placed in the housing. The transparent shell 8 does not conduct heat down to the ice but it does serve to form a pocket to keep cooled air within the housing 4 and surrounding a bottle. Of course, because cold air sinks while hot air rises, the housing 4 which is open at the top and closed at the bottom will tend to maintain cold air inside, with the air being cooled by the conductive shell 10. It has been found that as long as the heat conductive shell 10 surrounds about one-half or more of the bottle, the server will keep the bottle cool for a reasonable period of time, such as more than one hour.

The insulation layer 14 minimizes the flow of ambient heat to the conductive shell 10, thereby reducing the rate of melting of ice in the bottom of the housing 4. The insulating material 30 minimizes the flow of heat directly into the ice chamber at the bottom of the housing 4.

Test results comparing the server construction of the present invention with a server construction in which the cylindrical housing was composed entirely of heat conductive material is given below. The two servers were placed side by side in a normal indoor environment. Each server was stocked with the same amount of ice placed in the bottom of the server to substantially fill the area below the disk platform 20. Two 750 ml wine bottles of identical dimensions were filled with water and chilled in a refrigerator to an identical temperature of 38 degrees Fahrenheit. Enough water was poured out of each of the bottles so that when they were placed in their respective servers, the water levels in the bottles were substantially level with the top of their respective servers. The bottles and servers were then allowed to stand, while the temperatures of the water in the two bottles inside the two servers and the room temperatures were recorded with a thermocouple and potentiometer as follows:

| TIME | LIQUID TEMP. OF WATER IN BOTTLE IN SERVER OF PRESENT INVEN. (FAHRENHEIT) | LIQUID TEMP. OF WATER IN BOTTLE IN SERVER HAVING COMPLETE HEAT CONDUCTIVE CYLINDRICAL SHELL (FAHRENHEIT) | ROOM TEMPERATURE (FAHRENHEIT) |
|---|---|---|---|
| 1:35 p.m. | 38 degrees | 38 degrees | 72 degrees |
| 1:50 p.m. | 38 degrees | 38 degrees | 72 degrees |
| 2:05 p.m. | 38 degrees | 38 degrees | 73 degrees |
| 2:20 p.m. | 39 degrees | 39 degrees | 74 degrees |
| 2:35 p.m. | 40 degrees | 39 degrees | 74 degrees |

The test showed that the server of the present invention held the temperature of the liquid in the bottle within one or two degrees Fahrenheit of the refrigerator temperature for over an hour in a normally heated room. The server with the entire heat conductive cylindrical shell maintained the liquid temperature in its bottle only one degree lower over the same one hour period.

A server construction is thus described for both keeping cool wine bottles and the like, while also providing for displaying the contents of the server. Provision of the partial transparent sidewall only slightly reduces the effectiveness of maintaining the liquid in the bottle cool.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A server for wine bottles and the like comprising a housing open at the top for receiving a bottle and having a side wall shaped to generally conform to and surround the side exterior of the bottle, and a bottom wall joined at its perimeter to the side wall, the side wall and bottom wall forming a receptacle means for holding ice in contact with said side wall, support means within said housing above said bottom wall to hold the bottle above and out of contact with the ice, said support means having an opening therein to allow placement of ice into the receptacle means through the top opening of the housing, and at least about one-half of the area of said side wall comprising a heat conductive material, with the remaining area of the side wall comprising a substantially transparent material to enable seeing therethrough to the interior of the server, wherein at least a portion of the heat conductive material is contacted by ice placed in the receptacle means.

2. A server as in claim 1 wherein the conductive material of the side wall extends vertically from the bottom to the top of the server and around about one-half or more of the circumference of the server.

3. A server as in claim 2 further comprising a sheet of generally opaque material disposed to circumscribe the receptacle means generally below the support means.

4. A server as in claim 1 wherein said transparent material is formed into a cylindrical shell open at the top and joined at the bottom to the bottom wall, and wherein said heat-conductive material is formed into a generally hemi-cylindrical shell fitted within the cylindrical shell to extend from the receptacle means upward to the top of the housing.

5. A server as in claim 1 further comprising a second hemi-cylindrical shell made of an insulative material and disposed between the heat-conductive hemi-cylindrical shell and the transparent cylindrical shell.

6. A server as in claim 5 further comprising a layer of insulative material disposed against that portion of the interior surface of the transparent cylindrical shell below the support means which is not overlayed by the hemi-cylindrical shell of insulative material.

7. A server as in claim 1 wherein said opening in the support means is located adjacent the side wall of the housing.

8. A server for displaying and keeping cool wine bottles and the like comprising a housing open at the top for receiving a bottle and having a side wall for surrounding the entire side exterior of the bottle up to at least one-half the height of the enlarged portion of the bottle, and a bottom wall joined to the side wall to form a receptacle for holding ice in contact with the side wall, said side wall comprising a heat conductive material extending over about one-half or more of the area of the side wall and a transparent material extending over the remaining area of the side wall, at least a portion of said heat conductive material being disposed to contact ice placed in the receptacle and to surround some of the side exterior of the bottle, and support means within said housing above said bottom wall to hold the bottle above and out of contact with the ice, said support means having an opening therein to allow placement of ice into the receptacle means through the top opening of the housing.

9. A server as in claim 8 wherein the conductive material of the side wall forms a hemicylinder about the bottle, and wherein the transparent material of the side wall forms a cylinder which extends about the other side of the bottle to allow viewing said other side, and about the hemicylinder.

10. A server as in claim 9 further including a hemicylinder of insulative material disposed between the transparent cylinder and the heat conductive hemicylinder.

11. A sever as in claim 10 wherein said transparent material is comprised of a polycarbonate resin, said heat conductive material is comprised of aluminum, and said insulative material is comprised of closed cell foamed polyethylene.

12. A server as in claim 10 further comprising a cylindrical shell of generally opaque material surrounding said housing at and below the support means.

* * * * *